United States Patent [19]

Walmsley et al.

[11] 4,264,051

[45] Apr. 28, 1981

[54] LATERALLY ADJUSTABLE MULTIPLE HEAD

[75] Inventors: Stanley Walmsley, Wigan; William R. Aldridge, Hindley, both of England

[73] Assignee: Coal Industry (Patents) Limited, London, England

[21] Appl. No.: 970,166

[22] Filed: Dec. 18, 1978

[30] Foreign Application Priority Data

Jan. 17, 1978 [GB] United Kingdom ..... 01740/78

[51] Int. Cl.[3] ..... F21C 1/10; E21C 5/00

[52] U.S. Cl. ..... 248/660; 173/43; 173/52; 248/654

[58] Field of Search ..... 248/654, 651, 652, 657, 248/662, 660; 173/43, 38, 28, 45, 44

[56] References Cited

U.S. PATENT DOCUMENTS

| | | | |
|---|---|---|---|
| 2,675,996 | 4/1954 | Gunning | 173/43 |
| 2,731,235 | 1/1956 | Dellner | 173/43 |
| 3,295,800 | 1/1967 | Quarnstrom | 248/654 |
| 3,493,200 | 2/1970 | Huffman | 173/43 X |

FOREIGN PATENT DOCUMENTS

| | | | |
|---|---|---|---|
| 665920 | 2/1952 | United Kingdom . | |
| 677000 | 8/1952 | United Kingdom . | |
| 736762 | 9/1955 | United Kingdom . | |
| 811676 | 4/1959 | United Kingdom . | |
| 1042723 | 9/1966 | United Kingdom . | |
| 1380241 | 1/1975 | United Kingdom . | |
| 381750 | 9/1973 | U.S.S.R. | 173/43 |

*Primary Examiner*—J. Franklin Foss

*Attorney, Agent, or Firm*—Stevens, Davis, Miller & Mosher

[57] ABSTRACT

Drilling equipment comprises a single boom supporting a plurality of drilling masts each provided with a drilling machine, adjustment means being provided to simultaneously adjust the relative positions of the drilling masts.

8 Claims, 3 Drawing Figures

LATERALLY ADJUSTABLE MULTIPLE HEAD

The invention relates to excavating equipment and has more particular reference to drilling equipment having multiple drilling heads.

In the mining industry it is known to utilize drilling equipment having multiple drilling masts, each including a drilling machine for drilling holes in a rock face to receive explosive charges, the holes being arranged in a predetermined pattern according to the extent of the material to be removed by blasting. In the prior art equipment each drilling mast is mounted on a respective boom and is adjustable longitudinally of such boom to and from a drilling position. The individual booms are themselves both longitudinally and laterally adjustable by respective displacement means, thus to locate the heads at a requisite relative disposition.

The primary object of the present invention is to provide simplified drilling equipment comprising multiple heads.

According to the present invention there is proposed drilling equipment comprising a boom and a multiple of drilling masts mounted on the said boom.

According to a preferred feature, adjustment means are provided common to the multiple drilling masts adapted to effect simultaneous adjustmemt thereof relative to the said boom.

According to a still further feature, the said adjustment means are adapted to effect a corresponding adjustment of each drilling mast.

According to another preferred feature, the adjustment means are adapted and arranged to effect corresponding adjustment of each drilling mast thereby to vary the separation and/or the relative angular dispositions thereof.

By way of example only, the invention will now be described with reference to the accompanying drawings, in which.

Figure 1:
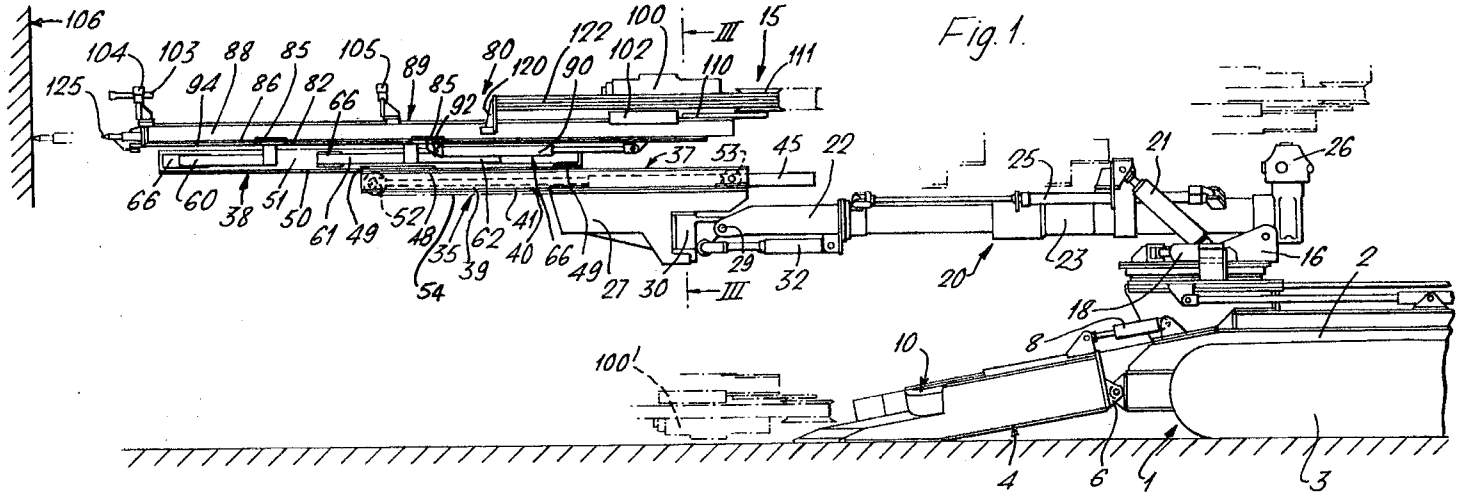
FIG. 1 is a side elevation of drilling equipment mounted on a mining machine (only the leading portion of which is shown), the drilling equipment being constructed in accordance with the present invention.

The drawings show a crawler track mining machine 1 having a chassis 2, crawler tracks 3 and a loading apron 4 inclined downwardly from the leading portion of the chassis towards the mine floor. The loading apron 4 is pivotally mounted onto the chassis by bracket means 6 and can be raised or lowered about the pivotal mounting by hydraulic rams 8 pivotally mounted to the loading apron and to the chassis. The upper working deck of the loading apron is provided with a reciprocating loading arm arrangement 10 which is described in more detail in the assignee's co-pending application Ser. No. 970,169 filed Dec. 8, 1978.

An operator's seat 12 and control panel 13 also are mounted on the chassis.

The mining machine 1 also includes rock or mineral drilling equipment 15 comprising a support turret 16 pivotally mounted on the chassis for movement about a generally vertical axis under the action of a hydraulic ram 18 pivotally secured to the chassis and to the support turret. The support turret 16 pivotally supports a forwardly extending telescopic boom 20 for pivotal movement about a generally horizontal axis under the action of a pair of hydraulic rams 21 pivotally mounted to the support turret and to the boom. The forward portion 22 of the telescopic boom is slidable relative to the rearward portion 23 to adjust the length of the telescopic boom under the action of a pair of hydraulic rams 25 each connected at its ends to the two portions 22, 23, respectively. Also, the forward portion 22 of the boom can be rotated about the longitudinal axis of the boom relative to the rearward portion 23 by a hydraulic motor 26 and gearing within the boom.

The foremost end of the forward portion 22 of the boom pivotally supports a support carriage 27 for pivotal movement about two mutually transverse axes is a horizontal axis 29 and a vertical axis 30 as seen in FIG. 1. Pivotal movement about axis 29 is controlled by hydraulic ram 32 connected to the support carriage and the forward portion of the boom and about axis 30 by a hydraulic ram (not shown) connected to the two parts of the support carriage 27 on opposite sides of the pivotal axis mounting.

The support carriage 27 supports an extensible beam arrangement 35 which is described in detail in the assignee's co-pending application Ser. No. 970,165 filed Dec. 18, 1978 and which comprises a first elongated beam element 37 slidably mounted on the upper deck 36 (see FIG. 3) of the support carriage 27 and a second elongated beam element 38 slidably mounted on the first beam element.

The first beam element 37 comprises two elongated channel formations 39 arranged back-to-back and the lower horizontal flanges 40 of which are provided with wear pads 41 slidable along the upper deck 36 of the support carriage. The lower horizontal flanges 40 are captivated to the support carriage by means of upstanding lip elements 43 projecting over the upper face of the flanges 40. A hydraulic ram 45 mounted between the two channel formations 39 has its cylinder component connected to the support carriage and its piston component connected to the first elongated beam element such that actuation of the ram 45 longitudinally moves the first beam element relative to the support carriage, the flanges 40 of the channel formations sliding within the lip elements 43.

The upper horizontal flanges 48 of the channel formations 39 are provided with lip elements 49 defining a slideway for a horizontal base plate 50 constituting part of the second elongated beam element 38 which also comprises a tubular formation 51 fixedly secured to the upper face of the base plate 50. The second beam element 38 is slid to and fro along the slideway defined by the lip elements 49 by the action of transmission means comprising two pulleys 52 and 53 provided adjacent to the opposite ends of the first beam element 37 and two cables 54 (only one of which is shown) arranged around the pulleys 52 and 53, respectively, and the ends of which are fixedly secured to the support carriage 27 and the second beam element 38. Thus in use, when the ram 45 is actuated to move the first beam element relative to the support carriage the transmission means are activated to move the second beam element relatively to the support carriage, the second beam element moving in the same direction as the first beam element but moving three times the distance moved by the first beam element.

The second beam element 38 is provided with three pairs of cranked arms 60, 61 and 62 which are pivotally mounted within the tubular formation 51 for hinged movement about vertical axes 63, 64 and 65, respectively and which project through slots 66 in the side walls of the tubular formation. The pivotal mounting 63 is located in a slide shoe 67 movable longitudinally along the tubular formation 51 under the action of a hydraulic ram 68 connected between the shoe 67 and the tubular formation. The pivotal mounting 65 is located in a slide shoe 70 movable longitudinally along the tubular formation 51 under the action of a hydraulic ram 72 connected between the shoe 70 and the tubular formation. The adjacent tubular formation 51 is cut away in FIG. 2 to expose details of the slide shoe 70 and the pivotal mounting 65 for the pair of arms 62.

The pivotal mounting 64 for the central pair of arms 61 is fixed relative to the tubular formation 51.

Figure 3:
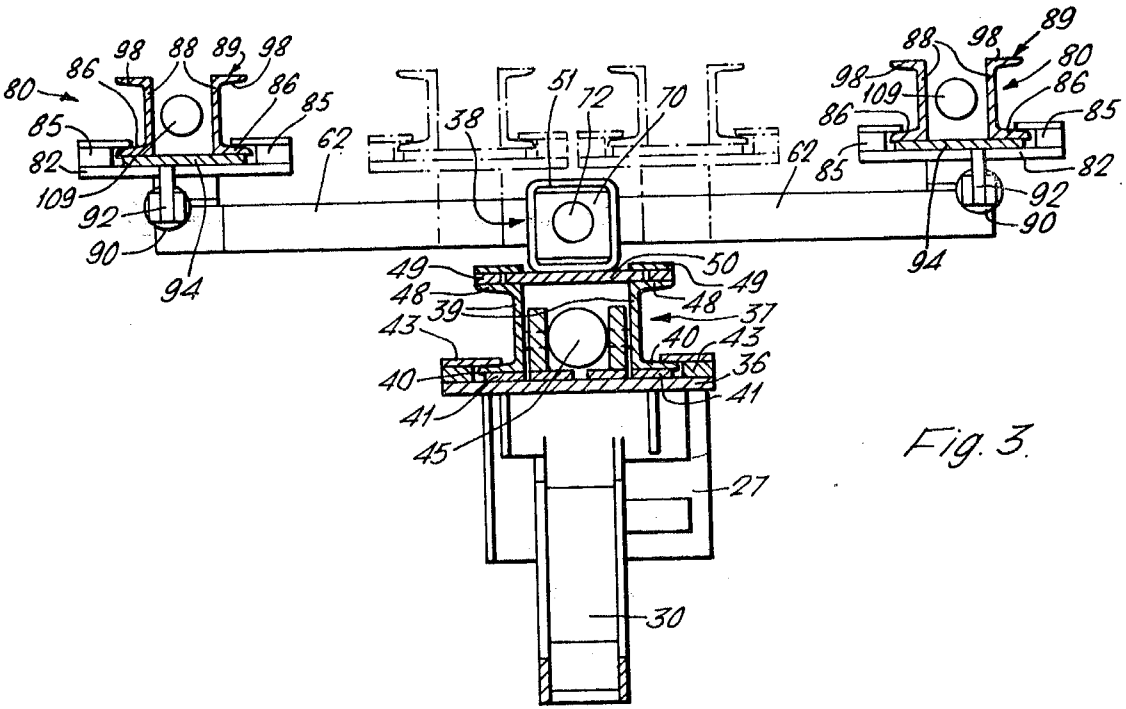
FIG. 3 is a sectional view along line III–III of FIG. 1.

The outer ends of the three pairs of cranked arms 60, 61 and 62 support two similar drilling masts 80, each comprising a deck plate 82 provided with pivotal mounting means 83 and 84 for pivotal connection to the adjacent arm 60 and to the adjacent arms 61, 62, respectively. The deck plate 82 has upstanding lip elements 85 for slidably captivating lower horizontal flanges 86 of two back-to-back channel formations 88 constituting at least part of an elongated beam element 89 slidable along the deck plate 82 under the action of a hydraulic ram 90 connected to the elongated beam formation 89 and the deck plate 82. As seen in FIG. 3, a bracket arrangement 92 at the rearmost end of the ram 90 extends through a slot in the deck plate 82 to fixedly engage a wear pad 94 provided on the bottom of the beam element 89.

The upper horizontal flanges 98 of the channel formations 88 slidably support a drilling machine 100 (not shown in FIGS. 2 and 3) which is provided with a downwardly extending lip arrangement 102 for slidably captivating the upper flanges 98. Two upstanding drill rod guides 104 and 105 are provided on the upper flanges 98 for guiding the drill rods 103 during advancement of the drilling machine during the rock excavating operation to form bore holes in a rock face 106 as will be explained later in this specification. The foremost guide 104 is fixed relative to the beam element 89 but the guide 105 has a slide arrangement slidably engaging the upper flanges 98 of the channel formations 88.

Figure 2:
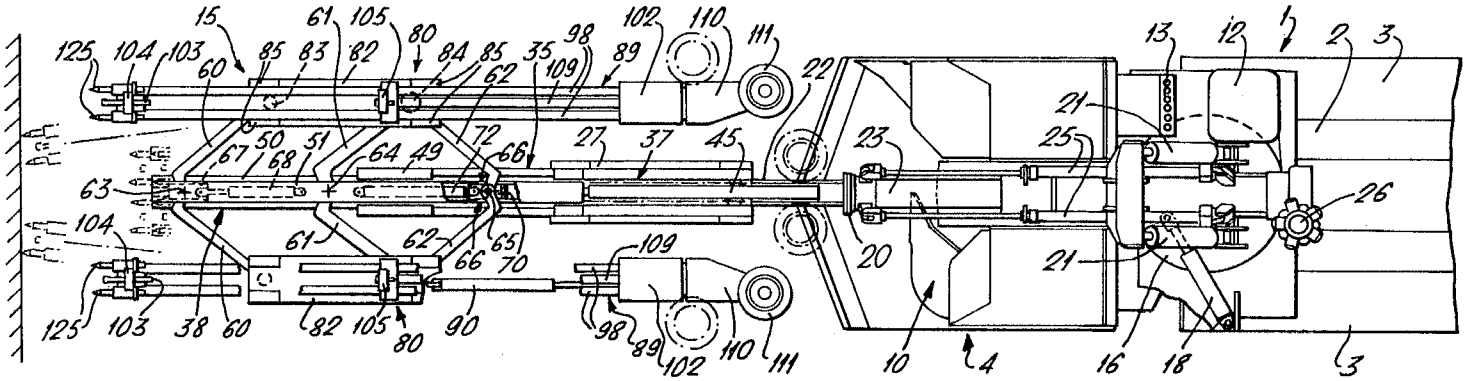
FIG. 2 is a plan of FIG. 1 (partly in section)

The drilling machine 100 and guide 105 are slid along the beam element 89 by the action of drive transmission means only a hydraulic ram 109 of which is shown in FIGS. 2 and 3. The piston rod of ram 109 is fixedly anchored to the extreme rearmost end of the beam element 89 such that when the ram is actuated its cylinder is slid along the beam element between the two back-to-back channel formations. A slide member 110 carrying a cable and hose guide pulley 111 and arranged to slide along the upper flanges 98 of the channel formations 88 is fixedly secured to the extreme rearmost end of the cylinder of ram 109 so that when the ram is actuated the slide member is slid along the beam element with the ram cylinder together with the previously mentioned drill rod guide 105 which is fixedly secured to the extreme forward end of the ram cylinder. A return pulley (not shown) mounted at the extreme forward end of the ram cylinder immediately below the drill rod guide 105 engages a roller chain (not shown) which is fixedly secured at one end to the previously mentioned downwardly extending lip arrangement 102 carrying the drilling machine 100 and at the other end to the channel formations 88 such that when the ram 109 is actuated to advance the cylinder forwardly along the beam element 89 the drilling machine is hauled forwardly at twice the speed of the guide 105 which is fixed secured to the ram cylinder. Thus, during operation when the drilling machine is advanced to urge the drill rod into the rock face the guide 105 always maintains a position substantially mid-way between the fixed drill rod guide 104 and the advancing drilling machine 100.

Upon completion of a bore hole the drilling machine 100 is hauled back along the beam element 89 towards the rearmost end of the beam element 89 by a cable secured at one end to the rear of the downwardly extending lip arrangement 102 carrying the drilling machine and at the other end to a stanchion 120 (only shown in FIG. 1) fixedly secured to the one channel formation 88 of the beam element 89, the cable intermediate its ends passing around the previously mentioned guide pulley 111 provided on the slide member 110 fixedly secured to the rearmost end of the ram cylinder. Thus, the drilling machine is hauled back along the beam element at twice the speed of the drill rod guide 105. The stanchion 120 and guide pulley 111 also serve to guide hydraulic supply hoses 122 for supplying pressure fluid to the drilling machine and hydraulic rams.

Two parallel rock engaging pins 125 provided on the front end of the beam element 89 are arranged to be urged against the rock face during drilling operations to help stabilize the extended drilling equipment.

In use, the mining machine 1 is located as near the rock face to be drilled as is conveniently possible. The rams 18 and 28 are actuated to suitably adjust the position of the boom 20 to the required position. The motor 26 is actuated to rotate the forward portion 22 of the boom such that both the drilling masts 80 and associated drilling machines 100 are at the desired position relative to the cross-section of the rock face to be drilled. In FIG. 1 the drilling machine is indicated in broken line in an inverted position adjacent to the mine floor at 100'.

Rams 25 and 45 are activated to extend the boom 20 and the extensible beam arrangement 35 until the foremost end of each drilling mast 80 is adjacent the rock face 106.

One or both of the rams 68, 72 are activated to simultaneously adjust the positions of both drilling masts 80 relative to the central extensible beam arrangement 35. Simultaneously adjustment of both rams 68 and 72 urges both the slide shoes 67 and 70 longitudinally along the tubular formation 51 to pivot the associated cranked arms 60, 62 about their pivotal mounting 63, 65. The pivotal mounting 64 which is fixed relative to the tubular formation 51 together with the action of its associated pair of cranked arms 61 causing both the drilling masts 100 to move by an equal amount literally either outwards or inwards, relative to the central beam arrangement 35 while at the same time maintaining the two drilling masts at a fixed inclination with respect to each other.

Adjustment of one ram 68 or 72 only urges only one pair of cranked arms 60 or 62 to pivot relative to the tubular formation 51 which together with the action of the fixed pivot mounting 64 and its associated pair of cranked arms 61 similarly varies the inclination of both drilling masts 80 relative to the central beam arrangement 35. In the drawings several scrap views of details of the drilling equipment are indicated in broken lines to illustrate various alternative positions taken up by the drilling equipment.

Once the drilling masts are in approximately the desired position a final adjustment of the position of the support carriage 27 is made, if necessary, before the rams 90 are activated to urge the beam elements 89 forward so that the pins 125 fixedly engage the rock face 106.

Finally both the drilling machines 100 are started and urged towards the rock face 106 by the action of the associated rams 109 of the drive transmission means so that both the drill rods 103 simultaneously are urged into the rock face to excavate the two bore holes.

Upon completion of the two bore holes, the drill rods 103 are withdrawn from the rock face by urging the drilling machines 100 rearwards along the beam elements 89 under the action of the associated drive transmission means 109. The positions of both the drilling masts then are adjusted and the above outlined procedure repeated until sufficient bore holes are drilled across the whole cross-sectional area of the working face.

The bore holes are then charged with explosive and the mining machine withdrawn a safe distance before the charges are exploded. The drilling machine then is advanced to load the broken rock debris using its loading apron 4 provided with the reciprocating loading mechanism 10.

Once the loading operation is complete the whole procedure is repeated to further extend the mine roadway within which the machine is located.

From the above description it will be appreciated that the present invention provides drilling equipment in which two boreholes can be simultaneously formed in a working face thereby enabling a rapid drilling procedure to be adopted. The invention provides drilling equipment having two drilling machines without the need for two forwardly extensible telescopic booms.

In other embodiments of the invention it may be sufficient to have a facility for one or other of the adjustment means for adjusting the relative positions of the two drilling masts.

Further the hydraulic rams 68, 72 may be replaced by a mechanical machine for example a rack and pinnion arrangement.

We claim:

1. Drilling equipment for mineral mining comprising:

(a) a mining machine having a support turret mounted for pivotal movement about a generally vertical axis;

(b) a forwardly extending boom mounted on the support turret for pivotal movement about a generally horizontal axis;

(c) at least two drilling masts mounted on the boom for movement toward and away from said turret; and (d) adjustment means connected between the boom and said at least two drilling masts to vary the relative angular disposition of the drilling masts in relation to the boom, the adjustment means comprising at least two sets of arms, the first set being on the forward end of said boom with one end of each arm being connected to a first actuating means for moving those arms inwardly and outwardly and the other ends of the arms being connected, respectively, to one of said drilling masts near the forward end thereof;

the second set of arms being mounted inwardly of said first set with one end of each arm being connected to a second actuating means for moving those arms inwardly and outwardly and the other ends of the arms being connected, respectively, to one of said drilling masts near the inward end thereof; and control means connected to said first and second actuating means for selective activation of one or both of the actuating means so as to move the drilling masts toward and away from each other in either parallel or non-parallel relationship.

2. Drilling equipment comprising a pivotally mountable support turret, a forwardly extending boom pivotally mounted on the support turret, multiple drilling mast components mounted on the boom, and adjustment means adapted to vary the relative dispositions of the drilling mast components in relation to the boom, the adjustment means comprising a central pivotal mounting component, a plurality of pivotal mounting means provided on the central pivotal mounting component and on the multiple drilling mast components, and a plurality of sets of at least three link arms associated with the multiple drilling mast components, respectively, the three link arms in each set extending from pivotal mounting means provided on the central pivotal mounting component to pivotal mounting means provided on the associated drilling mast component, at least two of the pivotal mountings associated with each set of three link arms being slidably mounted relative to the associated component.

3. Equipment as claimed in claim 2, comprising slide shoe means for at least one of the two of the pivotal mountings which are slidably mounted relatively to the associated component.

4. Equipment as claimed in claim 3, including ram means for controlling slide movement of the slide shoe means.

5. Equipment as claimed in claim 2, wherein the slidably mounted pivotal mountings are provided on the central pivotal mounting component.

6. Equipment as claimed in claim 5, wherein the pivotal mounting means associated with each set of three link arms and provided on the central pivotal mounting component comprises two slidably mounted pivotal mountings and one fixed pivotal mounting.

7. Equipment as claimed in claim 6, comprising means for moving the multiple drilling mast components to and fro relatively to the forwardly extending boom.

8. Equipment as claimed in claim 7, comprising a plurality of drilling means associated with the multiple drilling mast components, respectively, and means for moving each drilling means to and fro relative to the remainder of its associated drilling mast component.

* * * * *